US010100795B2

(12) United States Patent
Lamm et al.

(10) Patent No.: US 10,100,795 B2
(45) Date of Patent: Oct. 16, 2018

(54) HIGH PRESSURE PUMP FOR A FUEL INJECTION SYSTEM

(71) Applicant: Robert Bosch GmbH, Stuttgart (DE)

(72) Inventors: Marco Lamm, Leonberg (DE); Friedrich Boecking, Bangalore (IN)

(73) Assignee: Robert Bosch GmbH, Stuttgart (DE)

( * ) Notice: Subject to any disclaimer, the term of this patent is extended or adjusted under 35 U.S.C. 154(b) by 290 days.

(21) Appl. No.: 14/894,937

(22) PCT Filed: May 15, 2014

(86) PCT No.: PCT/EP2014/059971
§ 371 (c)(1),
(2) Date: Nov. 30, 2015

(87) PCT Pub. No.: WO2014/191220
PCT Pub. Date: Dec. 4, 2014

(65) Prior Publication Data

US 2016/0108875 A1 Apr. 21, 2016

(30) Foreign Application Priority Data

May 29, 2013 (DE) ..... 10 2013 210 036

(51) Int. Cl.
*F04B 53/16* (2006.01)
*F02M 59/10* (2006.01)
(Continued)

(52) U.S. Cl.
CPC ..... *F02M 59/102* (2013.01); *F02M 59/367* (2013.01); *F02M 59/44* (2013.01);
(Continued)

(58) Field of Classification Search
CPC ..... F02M 59/102; F02M 63/0001; F02M 63/0035; F02M 59/367; F02M 59/44;
(Continued)

(56) References Cited

U.S. PATENT DOCUMENTS 5,549,452 A * 8/1996 Vogt ..... F04B 1/053 417/199.1
6,116,870 A * 9/2000 Kraemer ..... F02M 59/464 417/490
(Continued)

FOREIGN PATENT DOCUMENTS

DE 102005052989 5/2006
DE 102008000705 9/2009
(Continued)

OTHER PUBLICATIONS

International Search Report for Application No. PCT/EP2014/059971 dated Sep. 4, 2014 (English Translation, 3 pages).

*Primary Examiner* — Charles Freay
*Assistant Examiner* — Thomas Fink
(74) *Attorney, Agent, or Firm* — Michael Best & Friedrich LLP

(57) ABSTRACT

The invention relates to a high pressure pump for a fuel injection system, in particular a common rail injection system, comprising a housing part (1) with a bore (2), in which a pump piston (3) is received such that it can be moved with a reciprocating movement, which pump piston (3) is supported via a tappet assembly (4) on a cam (5) or eccentric and delimits a pump working chamber (6) in the axial direction, which pump working chamber (6) can be filled with fuel via an upstroke valve (7) which is integrated into the high pressure pump. According to the invention, a feed bore (8) is configured in the housing part (1) in order to supply the upstroke valve (7) with fuel, which feed bore (8) is connected to a bore (11) of a further housing part (12), which bore (11) connects a pump interior chamber (9) and a tappet chamber (10).

11 Claims, 1 Drawing Sheet

(51) Int. Cl.

| | |
|---|---|
| ***F02M 59/44*** | (2006.01) |
| ***F02M 59/36*** | (2006.01) |
| ***F02M 63/00*** | (2006.01) |
| *F04B 9/04* | (2006.01) |
| *F02M 59/48* | (2006.01) |

(52) U.S. Cl.
CPC .... *F02M 63/0001* (2013.01); *F02M 63/0035* (2013.01); *F04B 53/16* (2013.01); *F02M 59/48* (2013.01); *F02M 2200/28* (2013.01); *F04B 9/042* (2013.01)

(58) Field of Classification Search
CPC .... F02M 59/48; F02M 2200/28; F04B 53/16; F04B 39/123; F04B 35/002; F04B 35/01; F04B 9/045; F04B 9/042; F04B 23/103; F04B 23/12
See application file for complete search history.

(56) References Cited

U.S. PATENT DOCUMENTS 6,139,284 A * 10/2000 Streicher ..... F02M 63/0225 417/273
6,722,857 B1 * 4/2004 Kellner ..... F02M 55/00 123/446
6,971,857 B2 * 12/2005 Nagai ..... F04B 1/0404 417/206
6,981,653 B2 1/2006 Boehland
7,052,257 B2 * 5/2006 Bodzak ..... F02M 39/005 418/109
7,178,509 B2 * 2/2007 Boos ..... F02M 59/06 123/495
7,278,348 B2 * 10/2007 Kleinbeck ..... F02M 59/102 92/155
7,284,537 B2 * 10/2007 Kleinbeck ..... F04B 1/0413 123/450
7,513,190 B2 * 4/2009 Boehland ..... F02M 59/102 417/273
7,571,713 B2 * 8/2009 De Luca ..... F04B 1/0448 123/446
7,775,193 B2 * 8/2010 Merz ..... F02M 59/102 123/495
8,272,856 B2 * 9/2012 Fuchs ..... F02M 59/464 137/533.13
2002/0189436 A1 * 12/2002 Frank ..... F02M 59/06 92/61
2004/0105761 A1 * 6/2004 Fehlmann ..... F02M 39/005 417/213
2004/0169092 A1 9/2004 Boehland
2005/0129532 A1 * 6/2005 Sano ..... F02M 59/102 417/273
2006/0144964 A1 * 7/2006 Boecking ..... F02M 45/086 239/533.2
2013/0022484 A1 * 1/2013 Fuchs ..... F02D 41/3845 417/490
2013/0025569 A1 * 1/2013 Langenbach ..... F02D 41/3854 123/456

FOREIGN PATENT DOCUMENTS

| | | | |
|---|---|---|---|
| DE | 102010001965 | 8/2011 | |
| DE | 102010001965 A1 * | 8/2011 | ..... F02M 55/02 |
| DE | 102010027745 | 10/2011 | |
| DE | 102010028036 | 10/2011 | |
| EP | 1310668 A2 | 5/2003 | |
| EP | 1557559 | 7/2005 | |
| GB | 2352780 | 2/2001 | |

* cited by examiner

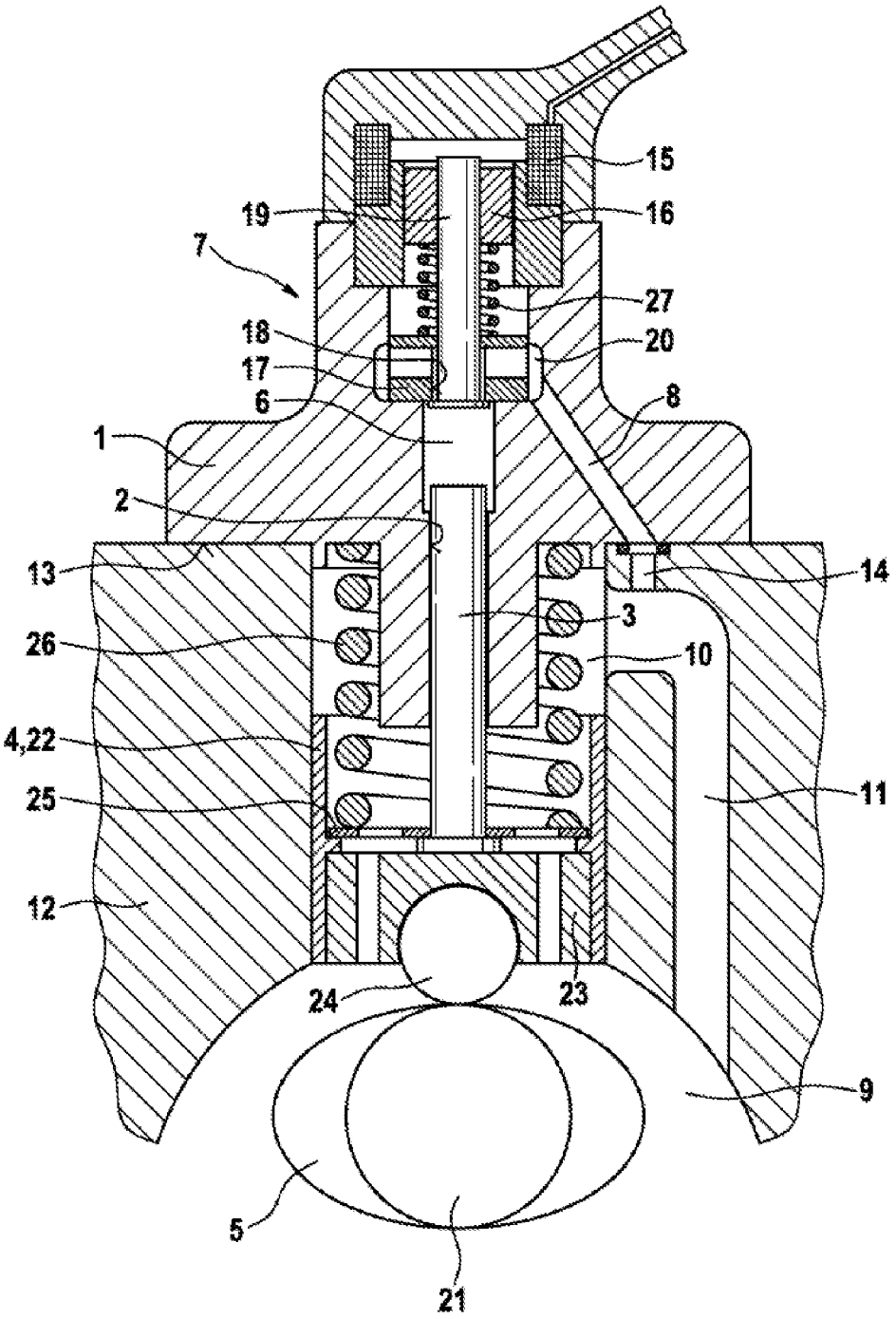
15
19
16
7
27
18
20
17
6
8
1
2
13
14
3
26
10
4,22
11
25
12
24
23
9
5
21

HIGH PRESSURE PUMP FOR A FUEL INJECTION SYSTEM

BACKGROUND OF THE INVENTION

The invention relates to a high pressure pump for a fuel injection system, in particular a common rail injection system.

A high pressure pump of the abovementioned type is disclosed by German Laid-Open Application DE 10 2010 027 745 A1, for example. It comprises a cylinder head and a pump assembly. The cylinder head has a cylinder bore, in which a pump piston of the pump assembly is guided. In this case, the pump piston delimits a pump working chamber in the cylinder bore. Moreover, the high pressure pump comprises an inlet valve, which is integrated into the cylinder head and via which fuel can be carried into the pump working chamber. The inlet valve is controllable and, in this way, can replace an upstream metering unit. By means of the inlet valve, it is possible to achieve complete filling and also partial filling of the pump working chamber through appropriate control of the inlet valve. The elimination of a metering unit leads to a significant cost reduction in the production of the high pressure pump.

SUMMARY OF THE INVENTION

Starting from the abovementioned prior art, it is the underlying object of the present invention to specify a high pressure pump of the type stated at the outset which can be produced in a simple and low-cost manner and furthermore has a low energy requirement.

The high pressure pump proposed for a fuel injection system, in particular a common rail injection system, comprises a housing part with a bore, in which a pump piston is accommodated in such a way that it can be moved with a reciprocating motion, which pump piston is supported via a tappet assembly on a cam or eccentric and delimits a pump working chamber in the axial direction, which pump working chamber can be filled with fuel via a suction valve, which is integrated into the high pressure pump. According to the invention, a feed bore is formed in the housing part in order to supply the suction valve with fuel, which feed bore is connected to a bore of a further housing part, which bore connects a pump interior chamber and a tappet chamber. The arrangement of a bore connecting the pump interior chamber to the tappet chamber to compensate hydraulic volumes is fundamentally known. A bore of this kind is provided especially in single-plunger pumps. In the high pressure pump according to the invention, the bore is not used only for volume compensation but also to supply the inlet valve with fuel. For this purpose, a feed bore in the first housing part is connected to the bore in the further housing part. The bore already present in the further housing part makes it unnecessary to form an additional feed bore passed through the further housing part of the high pressure pump in order to connect the suction valve to a low pressure region. The advantage of the present invention is therefore primarily to be seen in the elimination of the additional feed bore in the further housing part. This is because the production of the high pressure pump is simplified and production costs fall as a result.

According to a preferred embodiment of the invention, the housing part, which has a bore to accommodate the pump piston in such a way that it can be moved with a reciprocating motion, is flanged to the further housing part via a flange surface, and the feed bore for supplying the suction valve with fuel opens into this flange surface. In this case, the region in which the feed bore opens faces the further housing part, making connection to the bore present in the further housing part simple to achieve.

The feed bore is preferably connected to the bore connecting the pump interior chamber and the tappet chamber by a branch bore formed in the further housing part. Accordingly, all that is required to produce the connection is to bring the region in which the feed bore opens in the flange surface into overlap with the branch bore. The branch bore is preferably short and/or straight and/or opens in an abutment surface of the further housing part, said abutment surface lying opposite the flange surface of the first housing part. A bore of this kind can be produced in a simple and low-cost way.

As a measure constituting a further development, it is proposed that, downstream of the connection of the feed bore and/or the branch bore, the bore connecting the pump interior chamber and the tappet chamber has a free flow cross section which is reduced relative to that of the feed bore and/or the branch bore. Downstream refers to the flow direction of the fuel from the pump interior chamber in the direction of the tappet chamber. The reduction in the free flow cross section downstream of the connection of the feed bore and/or branch bore causes a pressure buildup upstream of the reduced cross section, which additionally assists the filling of the pump working chamber with fuel. The reduction in the flow cross section can be formed in the region of the opening of the bore into the tappet chamber, for example.

According to a preferred embodiment of the invention, the bore connecting the pump interior chamber and the tappet chamber is of handle-shaped design. Owing to its shape, the bore can therefore also be referred to as a handle-shaped bore. It is furthermore preferably taken right up to the abutment surface on which the flange surface of the first housing part rests and then opens into the tappet chamber via a preferably short bend. The branch bore preferably extends from the abutment surface to the bend. This makes it possible to keep the branch bore short.

It is advantageous if the suction valve is electromagnetically controllable and has a solenoid and an armature, which interacts with the solenoid. The controllability of the suction valve renders an upstream metering unit unnecessary, with the result that costs are further reduced by the elimination of the metering unit. On the one hand, there is a fall in production costs and, on the one hand, there is a fall in operating costs since the energy requirement is lowered by the elimination of the metering unit.

The suction valve preferably comprises a valve body, which is inserted into the bore in the housing part in which the pump piston is also accommodated. In this way, an arrangement of compact construction is achieved. As an alternative or in addition, it is proposed that the valve body of the suction valve should delimit the pump working chamber in the axial direction. Accordingly, the suction valve opens directly into the pump working chamber, allowing said chamber to be filled with fuel directly via the suction valve.

As a further preferred option, the valve body has an axial bore, in which a valve tappet is accommodated in an axially movable manner. Given an axial installation position of the suction valve, the direction of movement of the valve tappet thus corresponds to that of the pump piston. The valve tappet and the pump piston are preferably arranged coaxially. In this way, uniform and rapid filling of the pump working chamber with fuel is ensured.

In addition to the axial bore, the valve body furthermore has feed bores, which extend substantially radially and open into the axial bore. In order to connect the feed bores of the valve body to the feed bore leading to the suction valve, it is proposed that the valve body should be surrounded by an annular chamber, into which the feed bore leading to the suction valve opens. Via the annular chamber, all the feed bores formed in the valve body can be supplied with fuel, irrespective of the rotational position of the valve body.

To reduce production and/or operating costs of a high pressure pump, the measures proposed can each be implemented individually or in combination.

BRIEF DESCRIPTION OF THE DRAWING

The single drawing FIGURE shows a longitudinal section through a high pressure pump according to the invention according to a preferred embodiment.

SUMMARY OF THE INVENTION

The high pressure pump shown in longitudinal section comprises a housing part 12, in which a pump interior chamber 9 is formed. In the present case, the pump interior chamber 9 accommodates a drive shaft 21 with a cam 5, on which a pump piston 3 is supported via a tappet assembly 4. The tappet assembly 4 comprises a sleeve-shaped tappet body 22, in which a roller shoe 23 for the rotatable support of a roller 24 is accommodated. The tappet assembly 4 is connected to the pump plunger by a spring plate 25, wherein the spring plate 25 is acted upon in the direction of the cam 5 by the spring force of a spring 26. The spring force of the spring 26 holds the spring plate 25 and hence the pump piston 3 in contact with the tappet assembly 4.

The high pressure pump shown is designed as a single-plunger pump and, for volume compensation between the pump interior chamber 9 and a tappet chamber 10 formed within the sleeve-shaped tappet body 22, has a handle-shaped bore 11, which connects the pump interior chamber 9 to the tappet chamber 10.

A further housing part 1, which is referred to below as cylinder head 1, is flanged to housing part 12. A bore 2, in which the pump piston 3 is accommodated in such a way that it can be moved with a reciprocating motion, is formed in the cylinder head 1. In this case, the pump piston 3 delimits a pump working chamber 6, which is formed in the bore 2 and which is delimited by a valve body 17 of a suction valve 7 on the side facing away from the pump piston 3. The suction valve 7 is used to fill the pump working chamber 6 with fuel. For the purpose of supplying the suction valve 7 with fuel, a feed bore 8 is formed in the cylinder head 1, beginning at a flange surface 13 of the cylinder head 1 and ending at an annular chamber 20, which surrounds the valve body 17 of the suction valve 7. Via a branch bore 14 formed in the housing part 12, the feed bore 8 of the cylinder head 1 is connected to the handle-shaped bore 11, the connection of the suction valve 7 to a low pressure region of the high pressure pump thus being accomplished by this means. Accordingly, a separate feed bore for connecting the suction valve to the low pressure region can be eliminated. As a result, the high pressure pump shown can be produced in a simple and low-cost way.

Moreover, the suction valve 7 of the high pressure pump shown is electromagnetically controllable, thus furthermore making it possible to dispense with a metering unit upstream of the suction valve 7 for volume control. Production costs and also operating costs can thereby be further reduced. For electromagnetic control, the suction valve 7 has a solenoid 15, which interacts with an armature 16, the latter being designed in the present case as a plunger-type armature. The armature 16 is connected to a valve tappet 19, which is accommodated in an axial bore 18 in the valve body 17 of the suction valve 7 in such a way as to be axially movable. When the solenoid 15 is energized, the armature 16 pushes the valve tappet 19 out of its seat, and the suction valve 7 opens. In the closing direction, the valve tappet 19 is acted upon by the spring force of a spring 27 which, for this purpose, is supported at one end on the valve body 17 and at the other end on the armature 16. When the energization of the solenoid 15 is ended, the spring 27 pushes the valve tappet 19 back into its seat, and the suction valve 7 closes. During this process, the spring 27 is supported by the pressure conditions prevailing in the pump working chamber 6 during the delivery mode of the high pressure pump.

The invention claimed is:

1. A high pressure pump for a fuel injection system, comprising a housing part (1) with a bore (2), in which a pump piston (3) is accommodated in such a way that the pump piston can be moved with a reciprocating motion, which pump piston (3) is supported via a tappet assembly (4) on a cam (5) or an eccentric and delimits a pump working chamber (6) in an axial direction, which pump working chamber (6) is configured to be filled with fuel via a suction valve (7), which is integrated into the high pressure pump, characterized in that a feed bore (8) is formed in the housing part (1) in order to supply the suction valve (7) with fuel, which feed bore (8) is connected to a further bore (11) of a further housing part (12), which further bore (11) connects a pump interior chamber (9) and a tappet chamber (10), wherein the cam (5) or the eccentric is located within the pump interior chamber (9), wherein the feed bore (8) is connected to the further bore (11) by a branch bore (14) formed in the further housing part (12), wherein the further bore (11) is handle-shaped, having first and second portions connected by a bend, wherein the further bore (11) is at least partly located adjacent to a flange surface (13) of the first housing part (1) and directly connects to the tappet chamber (10) at the first portion, and wherein the branch bore (14) extends between the flange surface (13) and the first portion of the handle-shaped bore (11).

2. The high pressure pump as claimed in claim 1, characterized in that the housing part (1) is flanged to the further housing part (12) via the flange surface (13), and the feed bore (8) opens into the flange surface (13).

3. The high pressure pump as claimed in claim 1, characterized in that, downstream of the connection of the feed bore (8), the bore (11) connecting the pump interior chamber (9) and the tappet chamber (10) has a free flow cross section which is reduced relative to that of the feed bore (8).

4. The high pressure pump as claimed in claim 1, characterized in that the suction valve (7) is electromagnetically controllable and has a solenoid (15) and an armature (16), which interacts with the solenoid (15).

5. The high pressure pump as claimed in claim 1, characterized in that the suction valve (7) comprises a valve body (17), which is inserted into the bore (2) in the housing part (1).

6. The high pressure pump as claimed in claim 1, characterized in that the valve body (17) has an axial bore (18), in which a valve tappet (19) is accommodated in an axially movable manner.

7. The high pressure pump as claimed in claim 1, characterized in that the valve body (17) is surrounded by an annular chamber (20), into which the feed bore (8) opens.

8. The high pressure pump as claimed in claim 1, characterized in that, downstream of the connection of the branch bore (14), the bore (11) connecting the pump interior chamber (9) and the tappet chamber (10) has a free flow cross section which is reduced relative to that of the branch bore (14).

9. The high pressure pump as claimed in claim 8, characterized in that, downstream of the connection of the feed bore (8), the bore (11) connecting the pump interior chamber (9) and the tappet chamber (10) has a free flow cross section which is reduced relative to that of the feed bore (8).

10. The high pressure pump as claimed in claim 1, characterized in that the suction valve (7) comprises a valve body (17), which delimits the pump working chamber (6) in the axial direction.

11. The high pressure pump as claimed in claim 10, wherein the valve body (17) is inserted into the bore (2) in the housing part (1).

* * * * *